US010391655B2

(12) United States Patent
Votolato et al.

(10) Patent No.: US 10,391,655 B2
(45) Date of Patent: Aug. 27, 2019

(54) DUAL HEAD AND GUARD KNIFE

(71) Applicant: Spellbound Development Group, Inc., Newport Beach, CA (US)

(72) Inventors: Earl Votolato, Newport Beach, CA (US); Ryan Burkes, Huntington Beach, CA (US)

(73) Assignee: Spellbound Development Group, Inc., Newport Beach, CA (US)

( * ) Notice: Subject to any disclaimer, the term of this patent is extended or adjusted under 35 U.S.C. 154(b) by 0 days.

(21) Appl. No.: 15/943,043

(22) Filed: Apr. 2, 2018

(65) Prior Publication Data

US 2018/0222073 A1 Aug. 9, 2018

Related U.S. Application Data

(63) Continuation-in-part of application No. 15/144,285, filed on May 2, 2016, which is a continuation-in-part of application No. 14/931,093, filed on Nov. 3, 2015.

(60) Provisional application No. 62/486,870, filed on Apr. 18, 2017, provisional application No. 62/479,642, filed on Mar. 31, 2017.

(51) Int. Cl.
*B26B 29/02* (2006.01)
*B26B 5/00* (2006.01)

(52) U.S. Cl.
CPC ..... *B26B 29/025* (2013.01); *B26B 5/00* (2013.01)

(58) Field of Classification Search
CPC ..... B26B 5/00; B26B 29/025
See application file for complete search history.

(56) References Cited

U.S. PATENT DOCUMENTS

| | | | | |
|---|---|---|---|---|
| 1,426,184 | A | 8/1922 | Hammar | |
| 3,781,988 | A | 1/1974 | Jones | |
| 4,157,616 | A | 6/1979 | Lundqvist | |
| 4,238,862 | A | 12/1980 | Leatherman | |
| 4,531,286 | A | 7/1985 | Vito et al. | |
| 4,546,510 | A * | 10/1985 | Harrison | B26B 23/00 30/151 |
| 4,980,977 | A | 1/1991 | Matin et al. | |
| 5,478,346 | A | 12/1995 | Capewell | |
| 5,522,135 | A | 6/1996 | Votolato | |
| 5,676,677 | A | 10/1997 | Landis et al. | |
| 5,765,289 | A | 6/1998 | Schulz et al. | |
| 5,852,874 | A | 12/1998 | Walker | |

(Continued)

FOREIGN PATENT DOCUMENTS

| | | |
|---|---|---|
| CA | 2499895 C | 5/2010 |
| CA | 2746710 A1 | 7/2010 |
| WO | 2010078007 A2 | 7/2010 |

OTHER PUBLICATIONS

Office Action dated Jun. 28, 2017 for U.S. Appl. No. 14/931,093, 7 pages.

(Continued)

*Primary Examiner* — Omar Flores Sanchez
(74) *Attorney, Agent, or Firm* — Fish IP Law, LLP

(57) ABSTRACT

Contemplated tool and tool cartridge assemblies are provided that include at least one tool component and a movable cover. The movable cover has at least one guard portion that moves to cover or expose at least one tool component to protect a user from injury. Contemplated movable covers could be biased to cover tool components, and can be moved by a user or work piece as needed.

20 Claims, 6 Drawing Sheets

(56) References Cited

U.S. PATENT DOCUMENTS

| | | | | |
|---|---|---|---|---|
| 5,933,918 | A | 8/1999 | Wallays | |
| 6,029,355 | A | 2/2000 | Carlin | |
| 6,032,371 | A | 3/2000 | Chou | |
| 6,178,640 | B1 | 1/2001 | Votolato | |
| D446,571 | S | 8/2001 | Frazer | |
| 6,282,794 | B1 | 9/2001 | Cho et al. | |
| 6,493,945 | B1 | 12/2002 | DeRosa et al. | |
| 6,510,611 | B2 | 1/2003 | Edwards et al. | |
| 6,560,873 | B1 | 5/2003 | Ortner et al. | |
| 6,857,192 | B1 | 2/2005 | Summers et al. | |
| D521,844 | S | 5/2006 | Kempker et al. | |
| 7,082,688 | B2 | 8/2006 | Votolato | |
| D527,604 | S | 9/2006 | Kempker et al. | |
| 7,325,312 | B1 | 2/2008 | Janich | |
| D571,180 | S | 6/2008 | Marshall | |
| D575,613 | S | 8/2008 | Jennings | |
| 7,475,480 | B2 | 1/2009 | Votolato | |
| 7,509,742 | B2 | 3/2009 | Votolato | |
| 7,530,130 | B1 | 5/2009 | Frazer | |
| 7,533,595 | B2 | 5/2009 | Domenico | |
| D605,005 | S | 12/2009 | Benson | |
| 7,624,507 | B2 | 12/2009 | Bergstrand | |
| 7,665,389 | B2 | 2/2010 | Frazer | |
| 7,870,675 | B1 | 1/2011 | Della Polla | |
| D636,248 | S | 4/2011 | Still | |
| D639,631 | S | 6/2011 | Kempker et al. | |
| D649,001 | S | 11/2011 | Still | |
| 8,046,922 | B2 | 11/2011 | Eby et al. | |
| 8,099,868 | B1 | 1/2012 | Votolato | |
| 8,109,002 | B2 | 2/2012 | Frazer | |
| D660,674 | S | 5/2012 | Still | |
| D660,675 | S | 5/2012 | Gringer et al. | |
| 8,209,870 | B2 | 7/2012 | Votolato et al. | |
| 8,322,039 | B2 | 12/2012 | De Buyer-Mimeure | |
| D673,440 | S | 1/2013 | Kempker et al. | |
| 8,347,509 | B2 | 1/2013 | Votolato | |
| D682,065 | S | 5/2013 | Gringer et al. | |
| 8,590,163 | B1 * | 11/2013 | Bagley | B26B 11/008 30/123 |
| 8,677,629 | B2 | 3/2014 | Logan | |
| 8,732,956 | B2 | 5/2014 | McGushion et al. | |
| D714,611 | S | 10/2014 | Yu Chen | |
| D714,612 | S | 10/2014 | Gropl et al. | |
| 8,857,064 | B2 | 10/2014 | Schmidt | |
| 8,869,408 | B2 | 10/2014 | Votolato | |
| 9,061,426 | B2 | 6/2015 | Harvey | |
| D752,942 | S | 4/2016 | Rohrbach | |
| 9,346,177 | B2 | 5/2016 | Mayes | |
| 9,352,473 | B2 | 5/2016 | Harvey | |
| D767,966 | S | 10/2016 | Standlee | |
| D767,967 | S | 10/2016 | Standlee | |
| 2002/0124412 | A1 | 9/2002 | Votolato | |
| 2003/0079347 | A1 | 5/2003 | Davis | |
| 2003/0213133 | A1 | 11/2003 | Hanna | |
| 2004/0154167 | A1 | 8/2004 | Yu Chen | |
| 2005/0086811 | A1 | 4/2005 | Kawasaki | |
| 2005/0102844 | A1 | 5/2005 | Addis | |
| 2005/0217114 | A1 | 10/2005 | Votolato | |
| 2006/0048389 | A1 | 3/2006 | Votolato | |
| 2006/0288587 | A1 | 12/2006 | Ireland | |
| 2007/0068000 | A1 | 3/2007 | Onion | |
| 2007/0272061 | A1 | 11/2007 | Hsieh | |
| 2008/0010839 | A1 | 1/2008 | Eby et al. | |
| 2008/0201960 | A1 * | 8/2008 | Watanabe | B26B 29/02 30/151 |
| 2008/0271255 | A1 | 11/2008 | Frazer | |
| 2008/0271257 | A1 | 11/2008 | Frazer | |
| 2008/0271258 | A1 | 11/2008 | Frazer | |
| 2009/0100683 | A1 | 4/2009 | Lion et al. | |
| 2009/0151168 | A1 | 6/2009 | Dadam | |
| 2009/0172889 | A1 | 7/2009 | Votolato | |
| 2009/0271988 | A1 | 11/2009 | Votolato | |
| 2010/0192380 | A1 | 8/2010 | De Buyer-Mimeure | |
| 2010/0263217 | A1 | 10/2010 | Baxter et al. | |
| 2010/0263219 | A1 | 10/2010 | Kempker et al. | |
| 2010/0293796 | A1 | 11/2010 | Votolato | |
| 2011/0167646 | A1 | 7/2011 | Schmidt | |
| 2013/0298409 | A1 | 11/2013 | Jacobs et al. | |
| 2013/0326884 | A1 | 12/2013 | Harvey | |
| 2014/0345144 | A1 * | 11/2014 | Frazer | B26B 29/02 30/153 |
| 2014/0345146 | A1 | 11/2014 | Schekalla | |
| 2015/0298330 | A1 | 10/2015 | Yu Chen | |
| 2015/0336283 | A1 | 11/2015 | Davis | |
| 2017/0120469 | A1 | 5/2017 | Votolato | |

OTHER PUBLICATIONS

Office Action dated Aug. 9, 2017 for U.S. Appl. No. 14/931,093, 27 pages.

Office Action dated Mar. 2, 2018 for U.S. Appl. No. 14/931,093, 11 pages.

Office Action dated Aug. 16, 2018 for U.S. Appl. No. 14/931,093, 11 pages.

Notice of Ex Parte Reexamination, U.S. Pat. No. 6,718,840, filed Oct. 7, 2010, 19 pages.

Office Action for U.S. Appl. No. 15/144,285, dated Nov. 1, 2017, 5 pages.

Office Action for U.S. Appl. No. 15/144,285, dated Feb. 23, 2018, 21 pages.

Office Action for U.S. Appl. No. 15/144,285, dated Jun. 29, 2018, 5 pages.

Office Action for U.S. Appl. No. 15/144,285, dated Sep. 19, 2018, 5 pages.

W.A. Chapman, U.S. Pat. No. 594,984, dated Dec. 7, 1897, 3 pages.

International Preliminary Report on Patentability for International Application No. PCT/US2009/068389, dated Jul. 27, 2010, 7 pages.

* cited by examiner

DUAL HEAD AND GUARD KNIFE

This application claims the benefit of priority to U.S. Provisional Application No. 62/486,870, filed on Apr. 18, 2017, and U.S. Provisional Application No. 62/479,642, filed on Mar. 31, 2017. This application is also a continuation-in-part of, and claims priority to, U.S. application Ser. No. 15/144,285, filed on May 2, 2016, which is a continuation-in-part of, and claims priority to, U.S. application Ser. No. 14/931,093, filed on Nov. 3, 2015. All extrinsic materials identified herein are incorporated by reference in their entirety.

FIELD OF THE INVENTION

The field of the invention is tools and tool cartridges.

BACKGROUND

The background description includes information that may be useful in understanding the present invention. It is not an admission that any of the information provided herein is prior art or relevant to the presently claimed invention, or that any publication specifically or implicitly referenced is prior art.

Tools, including cutters, are used in various industries for various purposes (e.g., to open packaging, make repairs, fasten items together, make cuts, handle inventory, etc.). For example, many in food service and other industries use utility knives or other bladed tools to access packaged items. Regardless of how carefully people operate these tools; there remains a significant risk of injury, especially for employees who use the tools multiple times throughout their work day.

There have been a large number of injuries and expenses associated with these replaceable tool components caused by, among other things, (a) loose blades, screws or other small or sharp objects contaminating food and requiring an entire batch to be thrown out, (b) loose blades, screws or other small or sharp objects contaminating food served to a customer and potentially even causing injury to customers, (c) unauthorized use by customers who have access to tools being stored in shelves or lying around a store, and (d) user injuries that occur when grabbing and replacing the blades, screws or other sharp components.

The risk of injury may increase when tools that include multiple components are used (e.g., a cutter and a screwdriver). One reason is that sharp surfaces on one tool component often face the user or other people when the other tool component of the tool is in use. Additionally, where the sharp objects are replaceable, there is an even greater risk of the sharp objects coming loose and contaminating supplies or causing injuries.

Some have contemplated a guard or shield that covers a blade or sharp surface. For example, Votolato (U.S. Pat. No. 7,475,480) discloses a knife having a blade and blade shield. In another example, Kempker (U.S. Pat. Pub. No. 2010/0263219) and Jacobs (U.S. Pat. Pub. No. 2013/0298409) disclose a tool having a blade shield that overhangs over an edge of a blade to cover the blade edge. Other known efforts generally require users to manually unlock and move a guard, which increases the risk of injuries from (a) ergonomic issues and (b) tampering with, or removal of the safety features.

Although some efforts have been made in an attempt to address safety concerns, known efforts fail to provide an effective solution where multiple tool components are included in a single tool. Thus, there is still a need for improved tools and tool cartridges.

These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

SUMMARY OF THE INVENTION

The inventive subject matter provides apparatus, systems, and methods in which a tool comprises a blade holder coupled to a movable cover that alternatively exposes a first cutting edge and a second cutting edge. A contemplated tool comprises a blade holder that mounts a first cutting edge and a second cutting edge. A movable cover is coupled to the blade holder, such that the movable cover is configured to rotate relative to the blade holder to alternatively expose the first cutting edge and the second cutting edge. It should be appreciated that the movable cover can effectively prevent access to a cutting edge that is not in-use (i.e., not being used to cut) to thereby reduce the risk of injury to users.

In some aspects of the inventive subject matter, the movable cover is biased, such that the movable cover rotates to a position that covers at least one of the first cutting edge and the second cutting edge. In such embodiments, the tool can comprise a biasing member to bias the movable cover to a default position (e.g., a position where at least one cutting edge is covered). For example, the biasing member can be a spiral spring, which is a flexible material (e.g., a flexible plastic or metal) having the shape of a spiral that temporarily deforms when a load is applied (e.g., user presses tool against working surface to rotate movable cover and expose first or second cutting edge), and returns to its original shape when the load is removed (e.g., user lifts tool from working surface to cover first or second cutting edge). Other springs or biasing mechanisms are also contemplated.

It may be useful to restrict the movement of the moveable cover in some instances (e.g., when the tool is not used). In such instances, movable cover can be adjustable between (a) a locked configuration in which the movable cover is restrained from uncovering both the first cutting edge and the second cutting edge, and (b) an unlocked configuration in which the movable cover can uncover at least one of the first and second cutting edges. A movable cover can automatically or manually transition into the locked configuration after a cut is completed by a user. It is contemplated that the tool can further comprise a detent that restricts the movable cover from rotating relative to the blade holder.

Blade holder can comprise a stem having a flexible arm with a locking member. The stem could removably couple with a handle having a slot sized and dimensioned to receive the locking member. Thus, it is contemplated that the blade holder is removable from a handle (e.g., a cartridge having a blade holder and movable cover that removably couples a handle portion). However, in other embodiments, the blade holder is integral with (not removable from without damage) the handle.

In another aspect, a tool comprising a holder and a movable cover is contemplated. The holder mounts a first tool component and a second tool component. The movable cover is configured to move relative to the holder to simultaneously (i) allow access to the first tool component and (ii) restrict access to the second tool component. The movable cover is typically sized and dimensioned, such that the movable cover can rotate to a position that covers both the first and second tool components (e.g., any one of cutting edges, scrapers, screwdrivers, etc.). Contemplated first and second tool components can be any type of powered or unpowered tool, including screwdrivers, blades, scrapers, scissors, hammers, nail removers, piercer, or any combination thereof.

Various objects, features, aspects and advantages of the inventive subject matter will become more apparent from the following detailed description of preferred embodiments, along with the accompanying drawing figures in which like numerals represent like components.

DETAILED DESCRIPTION

The following discussion provides example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise. Also, as used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

The inventive subject matter provides tools including two or more tool components (e.g., powered or unpowered screwdrivers, blades, scrapers, scissors, hammers, nail removers, piercer, or any combination thereof), and at least one movable cover including a guard portion configured to move from a covered position to a working position that exposes at least one tool component that was previously covered. For example, it is contemplated that a movable cover is configured to rotate relative to a holder to alternatively expose a first tool component and a second tool component. In some embodiments, the movable cover could be spring loaded, and a locking mechanism (e.g., detent) could be provided to restrict movement of the movable cover.

It should be appreciated that movable covers of the inventive subject matter reduce the number of injuries to users by shielding against sharp tool components (e.g., cutting edges of blades, scrapers, screwdrivers). For example, where a movable cover is provided as part of a removable cartridge, a user need not touch the sharp tool components to replace the cartridge. Instead, the user could simply use the movable cover (covering some or all tool components) to remove and replace the cartridge from the handle. In the rare instance that a cartridge of the inventive subject matter detaches from the handle inadvertently (e.g., where a user grabs or operates the tool incorrectly), the cartridge as a whole could easily be seen and removed to prevent user injury, whereas a replaceable blade or other sharp object could easily be lost and only found after it causes an injury.

Figure 1A:
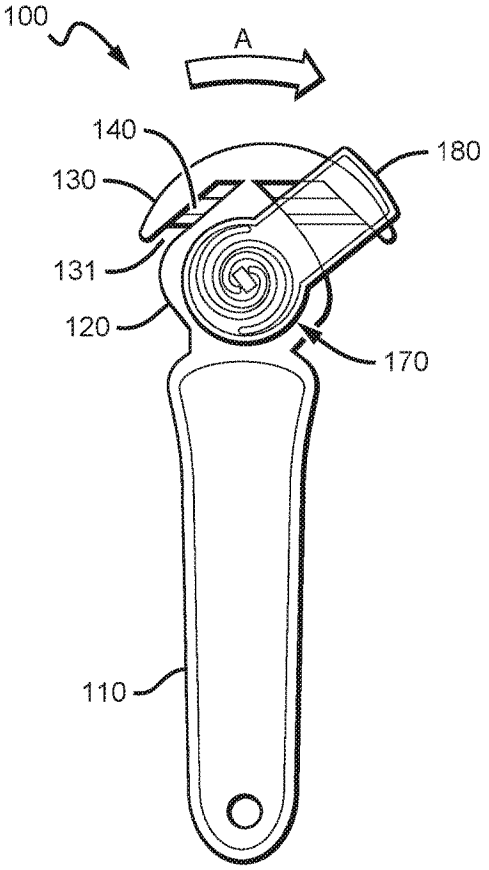
FIGS. 1A-1C show front views an embodiment of a tool having a movable cover.
Figure 1B:
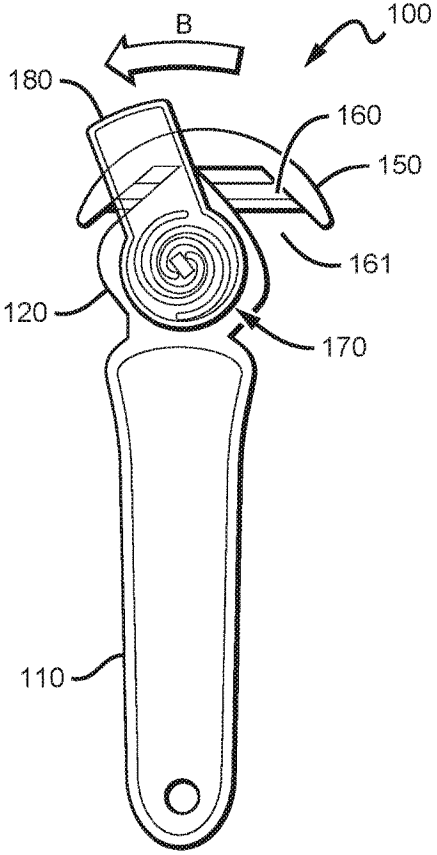
Figure 1C:
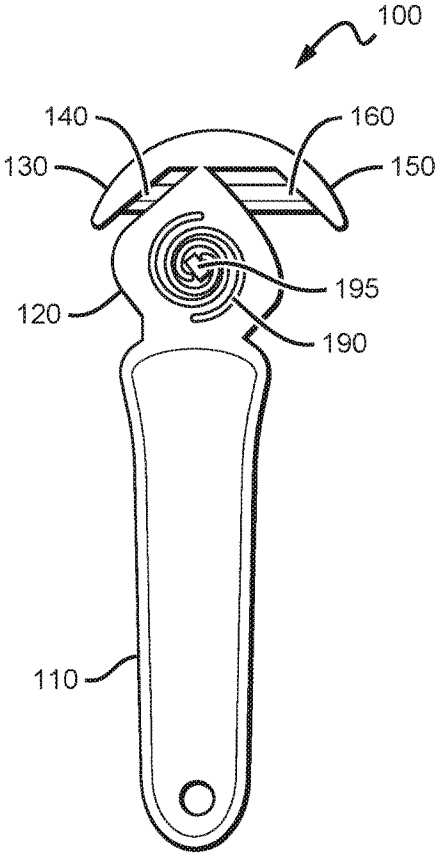

FIGS. 1A-1C illustrate a single unitary designed tool 100 in which some or all of the tool head components are an integral part of the handle. More specifically, tool 100 includes a handle portion 110 that is integral with (not removable from without damage) several tool head components. The tool head components include tool holder portion 120, a first tool component 140, a first overhanging shield 130, a second tool component 160, a second overhanging shield 150, a biasing member 190, and a movable cover 170 having a guard portion 180. Movable cover 170 could be rotatable or otherwise movable such that it moves between positions (e.g., a position covering first tool component 140, a position covering a second tool component 160, a position not covering any tool component).

Tool 100's tool components (140, 160) are first and second cutting edges that form hook knives in combination with overhanging shields 130 and 150. The first hook knife (130, 140) has a first channel 131 suitable for thinner objects (e.g., paper, shrink wrap, string, tape, fabric), while the second hook knife (140, 160) has a second channel 161 suitable for wider objects (e.g., rope, cardboard, bubble wrap). Tool holder portion 120 can be a blade holder mounting a single blade having the first and second cutting edges, or alternatively, mounting a first blade having the first cutting edge and a second blade having a second cutting edge.

Knives or tools having hook-type cutters can advantageously protect users from inadvertent cuts, as the blade's edge is recessed. Tool holder portion 120 (or blade holder) is sized and dimensioned to cover ends of each of the first and second cutting edges. As shown in FIGS. 1A-1C, overhand shields 130 and 150 of tool holder portion 120 cover the outer ends of the first and second cutting edges and a center portion of tool holder portion 120 covers the inner ends of the first and second cutting edges.

First channel 131 and second channel 161 are formed by covering both ends of each end of the first and second cutting edges. In this manner, tool holder portion 120 acts as a barrier or blocks the first and second cutting edges from objects that are larger than first channel 131 or second channel 161. As described above, first channel 131 is typically narrower than second channel 161. It is contemplated that first channel 131 and second channel 161 can be any suitable width, including between 1-20 mm, between 1-15 mm, between 1-10 mm, or between 5-15 mm, between 5-10 mm, or between 10-15 mm. In another example, first channel 131 and second channel 161 can be less than 20 mm, less than 15 mm, less than 10 mm, or less than 5 mm.

Such hook-type cutters have been found to be especially useful in cutting shrink wrap, bubble wrap, straps, bands, cardboard, and other items that are thin and can readily fit within at least one of first channel 131 and second channel 161. It is contemplated that a hook type cutter could be used to cut larger or thicker items, depending on the width of first channel 131 and second channel 161 leading to the first and second cutting edges. Additionally, it is contemplated that the end of at least one of overhand shields 130 and 150 could include a piercer such that an object can be pierced and cut open with a single swipe or other movement.

It may seem counterintuitive to at least some skilled in the art to include a movable cover over a tool component specifically designed to avoid injuries. However, Applicant surprisingly discovered that even hook knives, especially hook knives having wider angled channels, could pose a significant risk of injury. It was discovered that including a movable cover could help reduce or even eliminate such risks, and it does not require significant added costs.

Although the figures herein generally illustrate tools and tool cartridges including two hook knife or recessed cutting edges, it should be appreciated that contemplated tools and tool cartridges could include any suitable tool components of any suitable sizes (e.g., screwdrivers, blades, scrapers, nail removers, piercer, or any combination thereof).

In the embodiment shown, tool holder portion 120 is a blade holder that mounts first and second tool components 140 and 160. First and second tool components 140 and 160 can be first and second cutting edges, respectively. Tool holder portion 120 can further include a biasing member 190 that biases movable cover 170 to a default position. Biasing member 190 can be a spiral spring, which is a flexible material (e.g., a flexible plastic or metal) having the shape of a spiral that temporarily deforms when a load is applied (e.g., user presses tool against working surface to rotate movable cover and expose first or second cutting edge), and returns to its original shape when the load is removed (e.g., user lifts tool from working surface to cover first or second cutting edge). As shown, biasing member 190 includes a series of spiraled apertures or grooves. Movable cover 170 could include one or more pins or protrusions that are inserted into a cavity or recess 195 of biasing member 190 to thereby transfer rotational force from movable cover 170 to biasing member 190.

To operate tool 100 and make a cut using second tool component 160, a user could press tool 100 against a work surface to temporarily move movable cover 170, such that guard portion 180 rotates in direction B and exposes second tool component 160 via second channel 161. It is contemplated that the spiraled apertures of grooves of biasing member 190 are temporarily deformed while movable cover 170 is moved from its default position (covering second tool component 160 as shown in FIG. 1A). Upon completing the cut or lifting tool 100 from the work surface, movable cover 170 could automatically move in direction A, such that guard portion 180 covers second tool component 160 for storage or until further use. Thus, movable cover 170 is configured to rotate relative to tool holder portion 120 to alternatively expose first tool component 140 (in FIG. 1A) and second tool component 160 (in FIG. 1B).

It should be appreciated that guard portion 180 of movable cover 170 is configured to move relative to the tool holder portion 120 and to simultaneously (i) act as a physical barrier and restrict access to first tool component 140 via first channel 141 and (ii) allow access to second tool component 160 via second channel 161 for cutting (FIG. 1B), or vice versa (FIG. 1A). Although movable cover 170 is biased to cover second tool component 160 in the example above, it is contemplated that movable cover 170 can be biased to cover first tool component 140. In such embodiment, a user can press tool 100 against a work surface to temporarily move movable cover 170 in direction A to expose first tool component 140, and movable cover 170 would move in direction B upon completing the cut or lifting tool 100 from the work surface. Regardless of the biasing direction, biasing member 190 can be any type of spring that provides a directional bias to a default position, and requires a force (e.g., from a cutting surface or a user) to move movable cover 170 away from the default position. The spring force could be exerted by any material with elastic properties, could be integrally built into the tool as a unitary design, or could be a separate component that is assembled into the tool.

It is contemplated that the movable cover 170 could be manually retracted (pushed away from a tool component) and contracted (pushed over the tool component) without any biasing direction. Additionally or alternatively, movable cover 170 could manually retract but automatically be contracted by a spring, elastic or other force. Additionally or alternatively, movable cover 170 could manually contract but automatically be retracted by a spring, elastic or other force. It is also contemplated that a detent can be used to restrict movement of movable cover 170. For example, a detent can be used to (i) prevent movement of movable cover 170 when tool 100 is not used, and (ii) allow movement of movable cover 170 when tool 100 is pressed against a work surface (i.e., allow movement only when a predetermined force is applied to the movable cover).

In some embodiments, handle portion 110 and tool holder portion 120 are made from a single piece (e.g., an injection molded piece of plastic). In some embodiments, the handle portion 110, the tool holder portion 120, and the first and second overhanging shields 130 and 150 are made from a single piece. The biasing member 190 could be coupled with, affixed to, or form a part of tool holder portion 120, although it is also contemplated that biasing member 190 could be positioned on any portion of tool 100 that allows it to cover at least a portion of at least one of the tool components. It should be appreciated a single unitary designed tool (as shown in FIG. 1A) can have a second tool holder portion that mounts third and/or fourth tool components. The second tool holder portion can be disposed on the same end of a handle or on opposite ends of the handle. Additionally, or alternatively, the first and second tool holder portions can have the same or different combinations of tool components.

Figure 2A:
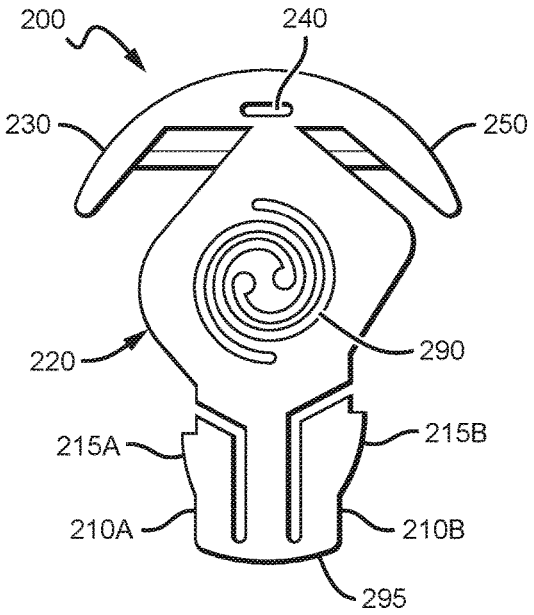
FIGS. 2A-2B show front views of an embodiment of a cartridge with and without a movable cover.

In FIG. 2A, a multi-tool removable cartridge 200 is shown without a movable cover. Tool cartridge 200 includes a tool holder portion 220, which is sized and dimensioned to hold one or more tool components (e.g., blade(s) with cutting edges) in place. Tool holder portion 220 includes a shield having overhanging shields 230 and 250, and an aperture 240 which allows dust and other debris trapped in tool cartridge 200 to escape. Tool holder portion 220 also includes a biasing member 290, which can be any type of spring that provides a directional bias to a default position, and requires a force (e.g., from a cutting surface or a user) to move a movable cover away from the default position as described above.

Tool holder portion 220 can also include a stem 295 having a first flexible spring arm 210A and a second flexible spring arm 210B. First flexible spring arm 210A includes a first locking member 215A, and second flexible spring arm 210B includes a second locking member 215B. First locking member 215A and second locking member 215B extend outwardly, and are sized and dimensioned to be received and locked in place by a slot of a handle. As shown in FIG. 2A, first flexible spring arm 210A and second flexible spring arm 210B have different lengths, with second flexible spring arm 210B being between 5-20% longer than first flexible spring arm 210A. However, it should be appreciated that each of the first and second arms could have any suitable lengths, including the same length.

Figure 2B:
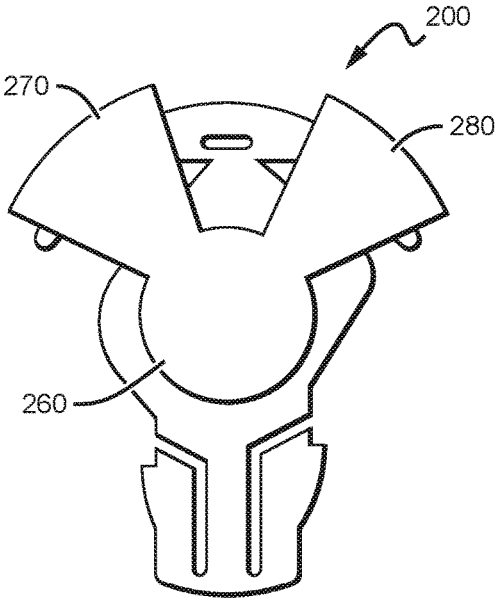

In FIG. 2B, movable cover 260 is coupled with tool holder portion 220, and includes a first guard portion 270 that is configured to be positioned over a first tool component, and a second guard portion 280 that is configured to be positioned over a second tool component. Movable cover 260 is biased towards a default position wherein each of cover portions 270 and 280 are positioned over a tool component (see FIGS. 4D and 4G). A user or a working surface could cause movable cover 260 to move from the default position in a direction that exposes the first tool component or the second tool component. In other embodiments, movable cover 260 can be coupled to tool holder portion 220 without any directional bias.

Figure 3:
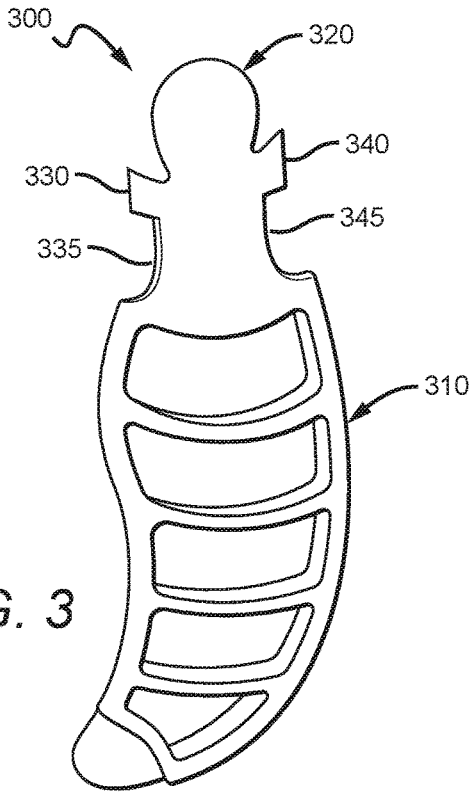
FIG. 3 shows a front view of an embodiment of a handle configured to releasably couple with the tool cartridge shown in FIGS. 2A-2B.

FIG. 3 illustrates a tool handle 300, which tool cartridge 200 or any other suitable tool cartridge described herein could releasably couple with. Tool handle 300 includes a gripping portion 310 and a tool cartridge receiving portion 320. Tool cartridge receiving portion 320 comprises a cavity sized and dimensioned to receive at least a portion of stem 295, and includes slots 335 and 345, which are sized and dimensioned to receive first locking member 215A and second locking member 215B of first and second spring arms 210A and 210B. It is contemplated that first and second locking members 215A and 215B extend through slots 335 and 345 at positions below protrusions 330 and 340.

Figure 4C:
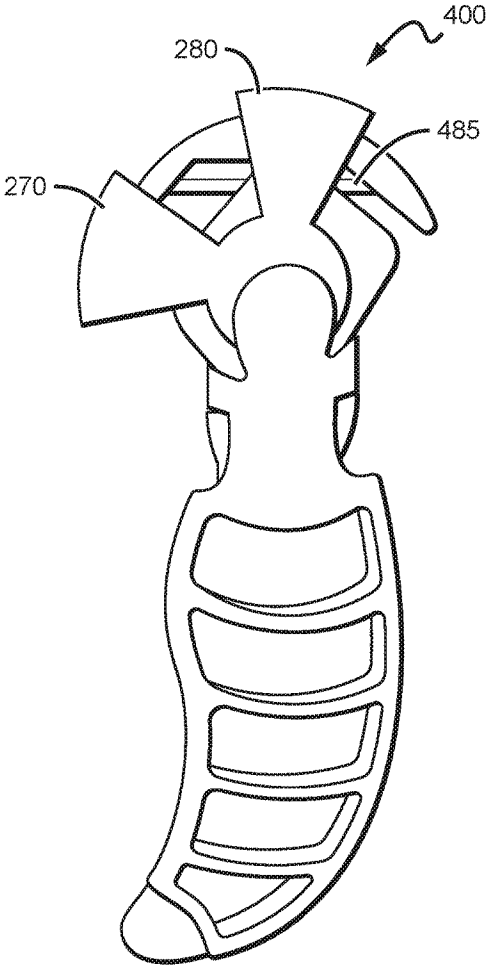
FIGS. 4B-4G show front perspective views of the movable cover exposing first and second cutting edges of the tool of FIG. 4A.
Figure 4B:
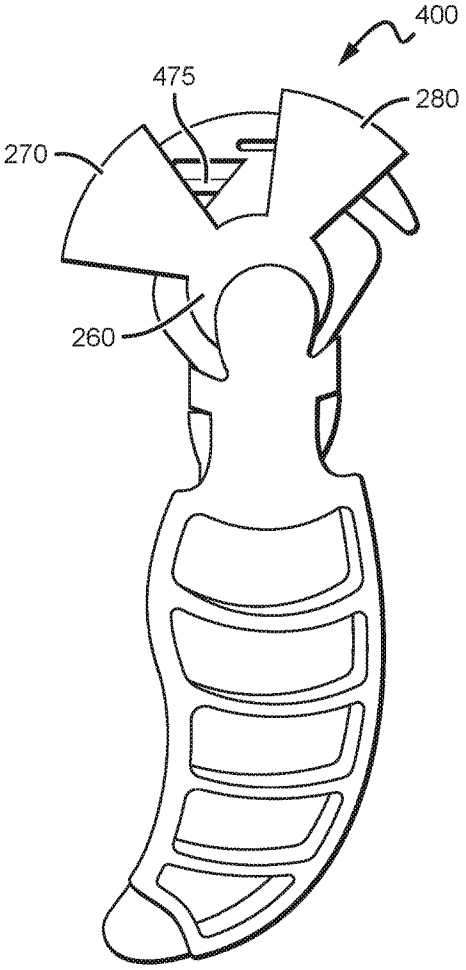
Figure 4A:
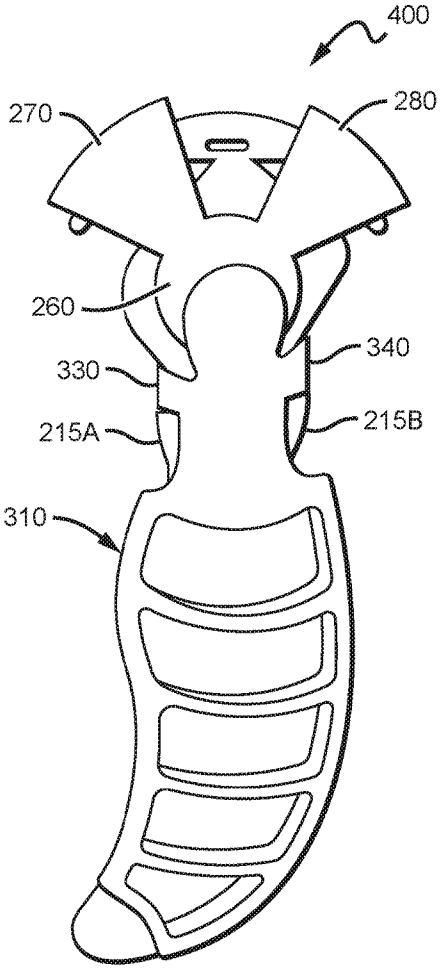
FIG. 4A shows a front view of an embodiment of a tool having the cartridge of FIGS. 2A-2B coupled with the handle of FIG. 3.

FIG. 4A illustrates a multi-tool 400, which is a combination of tool cartridge 200 and tool handle 300. As illustrated, tool cartridge 200 is coupled with tool handle 300 via tool receiving portion 320, slots 335 and 345, and locking members 215A and 215B of spring arms 210A and 210B. Movable cover 260 of tool cartridge 200 is partially seated within tool receiving portion 320 of tool handle 300. Preferably, movable cover 260 and tool receiving portion 320 are coupled to one another in a manner that allows guide portions 270 and 280 to move relative to the tool components (e.g., blades, screwdrivers, scrapers).

Tool handle 300 includes a first slot 335 sized and dimensioned to receive first locking member 215A of spring arm 210A, and a second slot 340 sized and dimensioned to receive second locking member 215B of spring arm 210B. When stem 295 of tool cartridge 200 is inserted into tool receiving portion 320 of tool handle 300, flexible arms 210A and 210B of tool cartridge 200 can flex towards each other (away from their resting positions) and snap into their resting position when locking members 215A and 215B extend through slots 335 and 345, respectively. From another perspective, flexible arms 210A and 210B of cartridge 200 could be configured such that, in a relaxed position, locking members 215A and 215B rest snugly and securely within slots 335 and 345 between gripping portion 310 and protrusions 330 and 340.

To remove tool cartridge 200 from tool handle 300, a user can squeeze locking members 215A and 215B and pull on tool cartridge 200. Additionally or alternatively, slots 335 and 345 that receive locking members 215A and 215B could be disposed on a top portion of tool handle 300 (above gripping portion 310), such that unintentional release of tool cartridge 200 from tool handle 300 during use can be avoided by a user holding gripping portion 310.

Figure 4F:
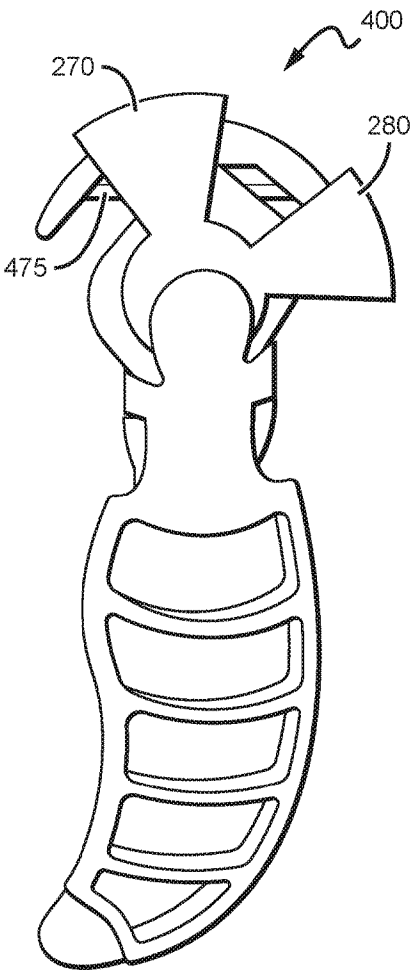
Figure 4E:
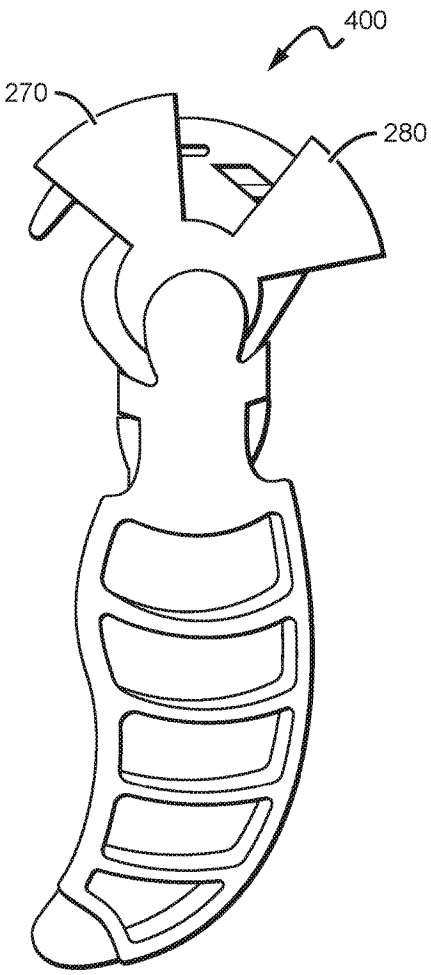
Figure 4D:
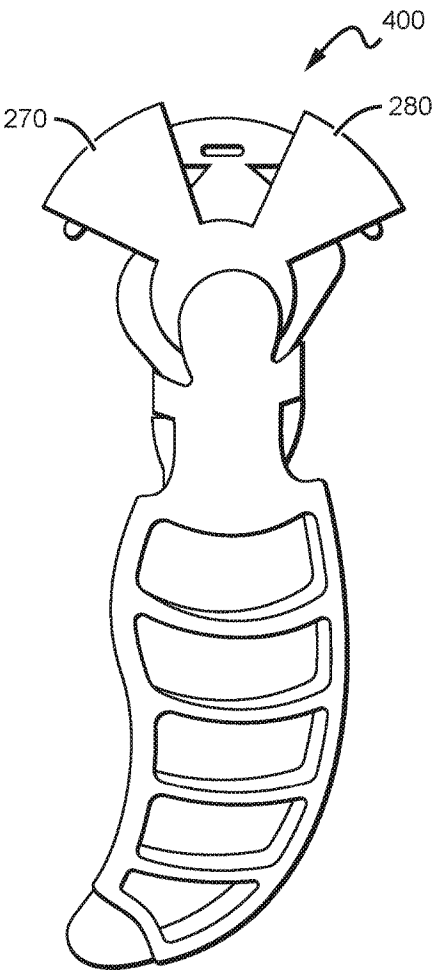

FIGS. 4B-4G illustrate a multi-tool 400 as movable guard 260 is bi-directionally moved relative to one or more tool components. In FIGS. 4B-4C, movable guard 260 is moved such that second guard portion 280 rotates from a default position (see FIG. 4A) to expose second tool component 485 (e.g., a second cutting edge). First guard portion 270 also rotates such that a portion of first tool component 475 (e.g., a first cutting edge) is exposed. However, first guard portion 270 continues to act as a barrier to the channel that leads to first tool component 475 to thereby prevent a user from being injured by first tool component 475. Preferably, the rotational range of movable cover 260 is limited such that first guard portion 270 does not rotate beyond a first edge 460 (see FIG. 4G) of the tool cartridge 200 when second tool component 485 is exposed. Once the user releases movable cover 260, first and second guard portions 270 and 280 automatically return to cover first and second tool components 475 and 485 simultaneously, as shown in FIG. 4D.

Figure 4G:
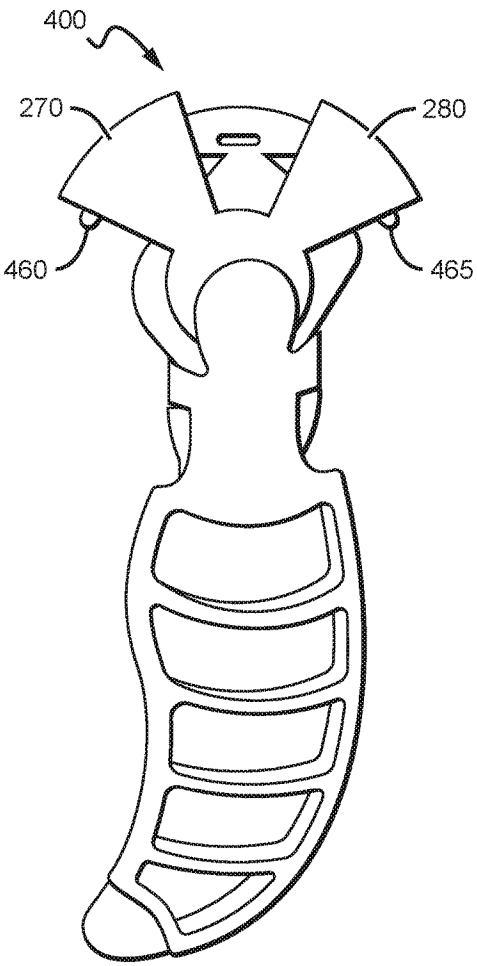

In FIGS. 4E-4F, movable guard 260 is moved such that first guard portion 270 rotates from a default position (see FIG. 4A) to expose first tool component 475 (e.g., a first cutting edge). Second guard portion 280 also rotates such that a portion of second tool component 485 is exposed. However, second guard portion 280 continues to act as a barrier to the channel that leads to second tool component 485 to thereby prevent a user from being injured by second tool component 485. Preferably, the rotational range of movable cover 260 is limited such that second guard portion 280 does not rotate beyond a second edge 465 (see FIG. 4G) of the tool cartridge 200 when first tool component 475 is exposed. Once the user releases movable cover 260, first and second guard portions 270 and 280 automatically return to cover first and second tool components 475 and 485 simultaneously, as shown in FIG. 4G.

Figure 5:
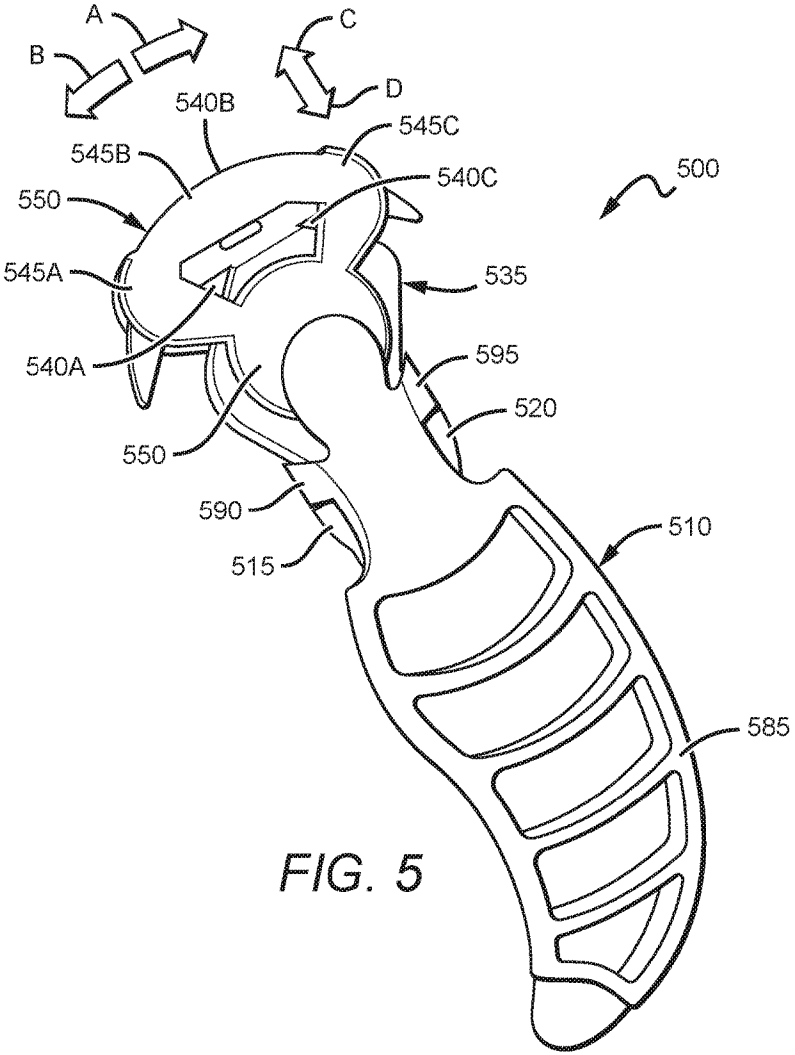
FIG. 5 shows a front perspective view of an embodiment of a tool having a movable cover and three tool components.

FIG. 5 illustrates another embodiment of a multi-tool 500 including three tool components and cover portions. Tool cartridge 535 comprises locking members 515 and 520 coupled with tool handle 510 via slots as described in the above embodiments. Tool cartridge 535's locking members 515 and 520 are disposed between a gripping portion 585 and protrusions 590 and 595 of tool handle 510. Tool cartridge 535 includes three tool components, and a movable cover 550 that is configured to move in four different directions (A, B, C, and D directions).

Movable cover 550 could be moved in Direction A from a default position (as shown in FIG. 5) in order to move first guard portion 545A and expose a first tool component 540A. Additionally, movable cover 550 could be moved in Direction B from default position (as shown in FIG. 5) in order to move second guard portion 545C and expose a second tool component 540C. Movable cover 550 can be coupled to a biasing member or a spring that allows movable cover 550 to rotate in Directions A and B.

Movable cover 550 could also be moved in Direction D from a default position (as shown in FIG. 5) to move third guard portion 545B and expose a third tool component 540B (e.g., a scraper). It is contemplated that movable cover 550 could be moved in Direction C manually or automatically (via a spring force) once tool 500 is lifted from working surface or a user force applied to movable cover 550 is removed to thereby cover third tool component 540B using third guard portion 545B.

Figure 6:
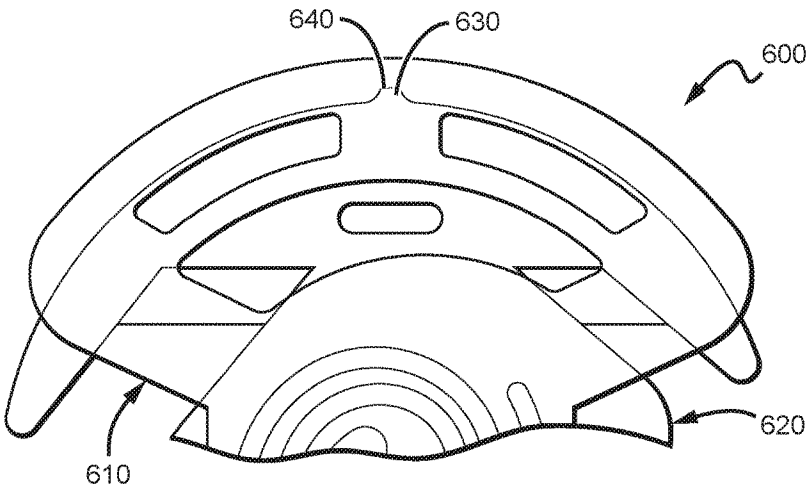
FIG. 6 shows an enlarged front view of an embodiment of a tool having a detent to restrict movement of the movable cover.

FIG. 6 shows an enlarged view of a tool 600 having a movable cover 610 and a tool holder portion 620. Movable cover 610 and tool holder portion 620 can include any of the elements (guard portions, tool components, biasing member, stem, locking members, etc.) described in the above embodiments. Furthermore, it is contemplated that tool 600 can further comprise a detent to restrict movement of movable cover 610 with respect to tool holder portion 620. For example, tool holder portion 620 can comprise a protrusion 630 that extends from a top end of tool holder portion 620, and movable cover 610 can comprise a recess 640 sized and dimensioned to receive protrusion 630 to restrict movement. In such example, movable cover 610 would be prevented from rotating when tool 600 is not being used. However, it is contemplated that a pre-determined force applied to movable cover 610 (e.g., pressing the tool onto a working surface or manually rotating the movable cover) can remove protrusion 630 from recess 640 to expose a tool component (e.g., a cutting edge, scraper, etc.).

Once the pre-determined force is removed, movable cover 610 can automatically rotate (via a spring force) to a default position where protrusion 630 rotates into recess 640 or an additional manual force may be applied to rotate protrusion 630 into recess 640. In other embodiments, a protrusion is disposed on movable cover 610 and a recess is disposed on tool holder portion 610. It is contemplated that such detent systems can be applied to tools described in the various other embodiments (e.g., tools 100, 400, 500).

Viewed from another perspective, it is contemplated that the movable cover is adjustable between (a) a locked configuration in which the movable cover is restrained from uncovering both a first cutting edge and a second cutting edge, and (b) an unlocked configuration in which the movable cover can uncover at least one of the first and second cutting edges. The transition between the locked and unlocked configuration can be accomplished by use of a pre-determined amount of force (e.g., pushing tool against a work surface or manually rotating the movable cover). Alternatively, the transition between locked and unlocked can require manual override (e.g., a button/trigger/actuator that triggers a locking/unlocking mechanism). When the movable cover is moved back to cover the tool components, the locking mechanism could reset to lock the movable cover in place until the user manually causes the lock to release again.

For example, a user could press a tool against a work surface (e.g., a surface to be cut) or manually rotate the movable cover to expose a tool component (e.g., a cutting edge) whereby the force applied by the surface or manual rotation transitions the movable cover from a locked to an unlocked configuration. Once the desired action (e.g., a cut through the work surface, screwing a screw through work surface, etc.) is completed, the movable cover could automatically (i) move to cover the tool component, and (ii) transition from the unlocked configuration to the locked configuration once the tool component is covered. It is contemplated that the steps of covering the tool component and/or transitioning from the unlocked configuration to the locked configuration can be manual (i.e., require user input). In other embodiments, the tool can be designed to require a user to manually unlock (via button, lever, handle, compression on an area of tool, etc.) movable cover in order to move movable cover and expose the first tool component. In such embodiment, movable cover would not move regardless if pressed against a work surface unless it was manually unlocked by the user.

It should also be appreciated that the tool can be designed to lock movable cover in a position that exposes a first tool component (e.g., cutting edge), such that a user is required to manually unlock movable cover so that movable cover rotates to cover the first tool component. For example, a user can press the tool against a work surface (e.g., a surface to be cut) or manually rotate the movable cover to expose a tool component (e.g., a cutting edge) whereby the force applied by the surface or manual rotation moves the movable cover to (i) expose the first tool component, and (ii) transition the movable cover into a locked configuration. Once the desired action (e.g., a cut through the work surface, screwing a screw through work surface, etc.) is completed, a user can manually unlock (via button, lever, handle, compression on an area of tool, etc.) movable cover in order to (i) automatically or manually move movable cover to cover the first tool component, and (ii) transition movable cover from the locked configuration to the unlocked configuration.

Figure 7:
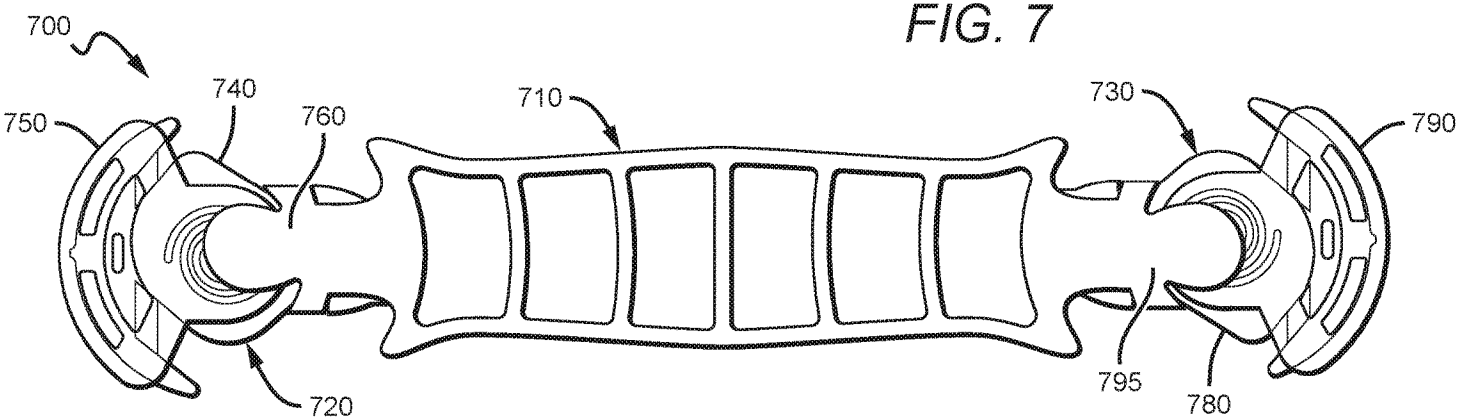
FIG. 7 shows a front view of an embodiment of a tool having first and second cartridges.

Although many of the embodiments describe a tool handle that receives one cartridge, it is contemplated that a tool handle can receive more than one cartridge. For example, FIG. 7 shows a tool 700 having a tool handle 710 that receives a first cartridge 720 and a second cartridge 730. First cartridge 720 includes a tool holder portion 740 and a movable cover 750. It is contemplated that first cartridge 720 can have the same configuration as the cartridges described above (e.g., cartridges 200 and 535). First cartridge 720 includes a biasing member that biases movable cover 750 to cover a first and second tool component (e.g., first and second cutting edges). However, a user or a working surface can temporarily rotate movable cover 750 to alternatively expose the first tool component and the second tool component.

As shown in FIG. 7, first cartridge 720 can be inserted into tool handle 710 through a first receiving portion 760 using the same method described above (see, e.g., tool cartridge 200 inserted/removed from tool handle 300). First receiving portion 760 is disposed on a first end of tool handle 710. A second cartridge 730 can be inserted in a second receiving portion 795 on a second end of tool handle 710. Second cartridge 730 includes a tool holder portion 780 and a movable cover 790. It is contemplated that second cartridge 730 can have the same configuration as the cartridges described above (e.g., cartridges 200 and 535). Second cartridge 730 can be inserted into tool handle 710 through second receiving portion 795 using the same method described above (see, e.g., tool cartridge 200 inserted/removed from tool handle 300).

First cartridge 720 could be the same as second cartridge 730 as shown in FIG. 7. In other words, first cartridge 720 and second cartridge 730 can have the same elements (e.g., tool holder portion, movable cover, biasing member, first and second tool components, etc.) in the same configuration. However, in other embodiments, first cartridge 720 could be different from second cartridge 730. For example, first cartridge 720 and second cartridge 730 could have at least one of different tool components, different types of movable covers (e.g., a rotatable vs. slidable), different number of tool components (e.g., two components vs. three components), different types of tool components (e.g., blades vs. scraper) and different elements (e.g., with movable cover vs. without movable cover).

As shown in FIG. 7, tool handle 710 can receive two cartridges on opposite ends of the handle. It is contemplated that a handle can include additional receiving portions to receive more cartridges along the body of the handle. In other embodiments, a tool can have two receiving portions on the same end of a handle (e.g., adjacent to one another) that each receives a cartridge. In another embodiment, a tool can have a first receiving portion on first end of a handle and a second receiving portion on an area of the handle between the first end and a second end of the handle.

Although many of the embodiments described rotational movement to expose a first or second tool component, it is contemplated that a movable cover can pivot, slide, swivel, turn, bend or flex to uncover a first or second tool component. Additionally, or alternatively, it is contemplated that a movable cover can be slid or rotated to uncover both first and second tool components (e.g., first and second cutting edges). Additionally, or alternatively, it is contemplated that first and second guard portions that cover first and second tool components can move independently from one another (e.g., guard portions are disposed on different movable covers).

Methods of making tools as described are also contemplated. A cartridge having first and second cutting edges can be assembled by fixing a blade (having two cutting edges) or two blades (each having one cutting edge) to the cartridge. The blade can be made of metal, plastic, ceramic, wood, bone, keratin, enamel, carbon, stone, obsidian, glass, diamond, or any other material suitable for cutting or applying directed pressure. Further, the blade may be straight, curved, round, angled, serrated, sharpened, dulled, or otherwise configured as appropriate for the desired use. The cartridge and tool handle may be a single piece or the composite of several pieces. The cartridge and tool handle could be of the same material (e.g., injection molded plastic) or of a range of materials.

The movable cover can be an integral part of the blade holder and can be made of the same material as the blade holder. For example, the movable cover and blade holder can be made of a single piece of flexible rubber or rigid plastic. Further, the movable cover and blade holder can be made primarily of the same material as an integral piece, while the blade holder is further comprised of other components or materials. The movable cover and the blade holder can also be separate components, and can be made of different materials or the same material. The movable cover can be fixed to the blade holder by means that permit the blade cover to rotate (partially or fully), pivot, slide, swivel, turn, bend, flex or otherwise move in relation to the blade.

The movable cover and the blade holder can be attached at a junction. The junction can be further configured such that a part of the junction prevents or allows the movable cover to move in relation to the blade holder, while another part of the junction provides the avenue or means for the movable cover to move in relation to the blade holder. The means of preventing or allowing movement, and restricting the direction of movement, of the movable cover in relation to the blade holder can be an integral part of the junction between the blade movable and the blade holder, or can be a separate component. Further, the components can be made of the same or different materials.

A cartridge having a blade holder (or tool holder portion) as described above can further be made by fixing flexible spring arms to the blade holder. The flexible arms can be a separate component from the blade holder or can be an integral aspect of the blade holder. The flexible arms and blade holder can be made of the same material or of different materials. The flexible arms can be configured such that they flex inwardly from a rest position while being inserted into a tool handle, and then return to the rest position once completely inserted into the tool handle.

Moreover, and unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

It should be apparent, however, to those skilled in the art that many more modifications besides those already described are possible without departing from the inventive concepts herein. The inventive subject matter, therefore, is not to be restricted except in the spirit of the disclosure. Moreover, in interpreting the disclosure all terms should be interpreted in the broadest possible manner consistent with the context. In particular the terms "comprises" and "comprising" should be interpreted as referring to the elements, components, or steps in a non-exclusive manner, indicating that the referenced elements, components, or steps can be present, or utilized, or combined with other elements, components, or steps that are not expressly referenced.

What is claimed is:

1. A tool, comprising:

a blade holder mounting a first cutting edge and a second cutting edge, the first and second cutting edges separated by a portion of the blade holder; and a movable cover coupled to the blade holder, such that the movable cover is configured to rotate relative to the blade holder to alternatively expose the first cutting edge and the second cutting edge.

2. The tool of claim 1, wherein the moveable cover is sized and dimensioned such that the moveable cover can rotate to a position that covers both the first cutting edge and the second cutting edge simultaneously.

3. The tool of claim 1, wherein the first cutting edge is disposed in a first channel of the blade holder, the second cutting edge is disposed in a second channel of the blade holder, and the first channel is narrower than the second channel.

4. The tool of claim 1, wherein the movable cover is adjustable between (a) a locked configuration in which the movable cover is restrained from uncovering both the first cutting edge and the second cutting edge, and (b) an unlocked configuration in which the movable cover can uncover at least one of the first and second cutting edges.

5. The tool of claim 1, wherein the first and second cutting edges are disposed on a single blade.

6. The tool of claim 1, wherein the first cutting edge is disposed on a first blade, and the second cutting edge is disposed on a second blade that is different than the first blade.

7. The tool of claim 1, further comprising a biasing member that biases the movable cover, such that the movable cover rotates to a position that covers at least one of the first cutting edge and the second cutting edge.

8. The tool of claim 7, wherein the biasing member is a spiral spring.

9. The tool of claim 1, wherein the blade holder is sized and dimensioned to cover ends of each of the first and second cutting edges.

10. The tool of claim 1, further comprising a stem having a flexible arm with a locking member.

11. The tool of claim 10, further comprising a handle having a slot sized and dimensioned to receive the locking member and thereby couple the blade holder.

12. The tool of claim 1, wherein the moveable cover has two separate guard portions.

13. The tool of claim 1, further comprising a tool component disposed on a top edge of the blade holder.

14. The tool of claim 13, wherein the movable cover is sized and dimensioned such that the movable cover can slide to a position that uncovers the tool component.

15. The tool of claim 13, wherein the tool component is a scraper.

16. The tool of claim 1, further comprising a detent that restricts the movable cover from rotating relative to the blade holder.

17. A tool, comprising:

a holder mounting a first tool component and a second tool component;

a movable cover coupled to the holder, such that the movable cover is configured to move relative to the holder to simultaneously (i) allow access to the first tool component and (ii) restrict access to the second tool component; and wherein the moveable cover is sized and dimensioned such that the moveable cover can move to a position that covers both the first tool component and the second tool component simultaneously.

18. The tool of claim 17, wherein the first tool component is a first cutting edge and the second tool component is a second cutting edge.

19. The tool of claim 17, wherein the first tool component is a scraper and the second tool component is a first cutting edge.

20. The tool of claim 17, further comprising a detent that restricts the movable cover from moving relative to the blade holder.

* * * * *